US007578454B2

(12) United States Patent
Joo

(10) Patent No.: US 7,578,454 B2
(45) Date of Patent: Aug. 25, 2009

(54) SPRAY DEVICE FOR FIRE FIGHTING

(75) Inventor: Kwang-Il Joo, Busan (KR)

(73) Assignee: Tank Tech Co., Ltd. (KR)

( * ) Notice: Subject to any disclaimer, the term of this patent is extended or adjusted under 35 U.S.C. 154(b) by 134 days.

(21) Appl. No.: 11/632,574

(22) PCT Filed: Nov. 1, 2004

(86) PCT No.: PCT/KR2004/002781

§ 371 (c)(1),
(2), (4) Date: Jan. 16, 2007

(87) PCT Pub. No.: WO2006/009337

PCT Pub. Date: Jan. 26, 2006

(65) Prior Publication Data

US 2008/0083543 A1 Apr. 10, 2008

(30) Foreign Application Priority Data

Jul. 16, 2004 (KR) ..... 10-2004-0055602

(51) Int. Cl.
*B05B 1/34* (2006.01)

(52) U.S. Cl. ..... 239/488; 239/463; 239/487; 239/491; 239/565; 239/567; 239/DIG. 4; 169/37

(58) Field of Classification Search ..... 239/207, 239/208, 209, 380–383, 461–464, 474, 487, 239/488, 490, 491, 550, 552, 553, 553.3, 239/565, 567, 590–590.5, DIG. 4; 169/37
See application file for complete search history.

(56) References Cited

U.S. PATENT DOCUMENTS

| | | | | |
|---|---|---|---|---|
| 2,361,144 | A | 10/1944 | Loepsinger | |
| 4,989,675 | A | 2/1991 | Papavergos | 169/14 |
| 5,014,790 | A | 5/1991 | Papavergos | 169/44 |
| 6,315,219 | B1 * | 11/2001 | Palestrant | 239/550 |

* cited by examiner

*Primary Examiner*—Christopher S Kim
(74) *Attorney, Agent, or Firm*—Cantor Colburn LLP

(57) ABSTRACT

The present invention provides a spray device for fire fighting, which sprays atomized water to extinguish a fire. The spray device (100) includes an upper body (10), a lower body (20) which is removably coupled to the upper body (10), a nozzle tip (30) which has a swirl (39) therein and is removably inserted into each nozzle tip hole (22) of the lower body (20), and an interposition unit (40). The spray device (100) further includes an inclined surface (16), a tightening contact surface (19-1) provided on an outer surface of a circular head part (19) of the upper body (10), a working groove (26) to provide an internal thread (25) on the lower body (20), and a hemispherical mesh (42) which has a convex shape and is provided in a chamber (41) defined at a center position between the upper body (10) and the lower body (20).

3 Claims, 9 Drawing Sheets

【Fig.2】
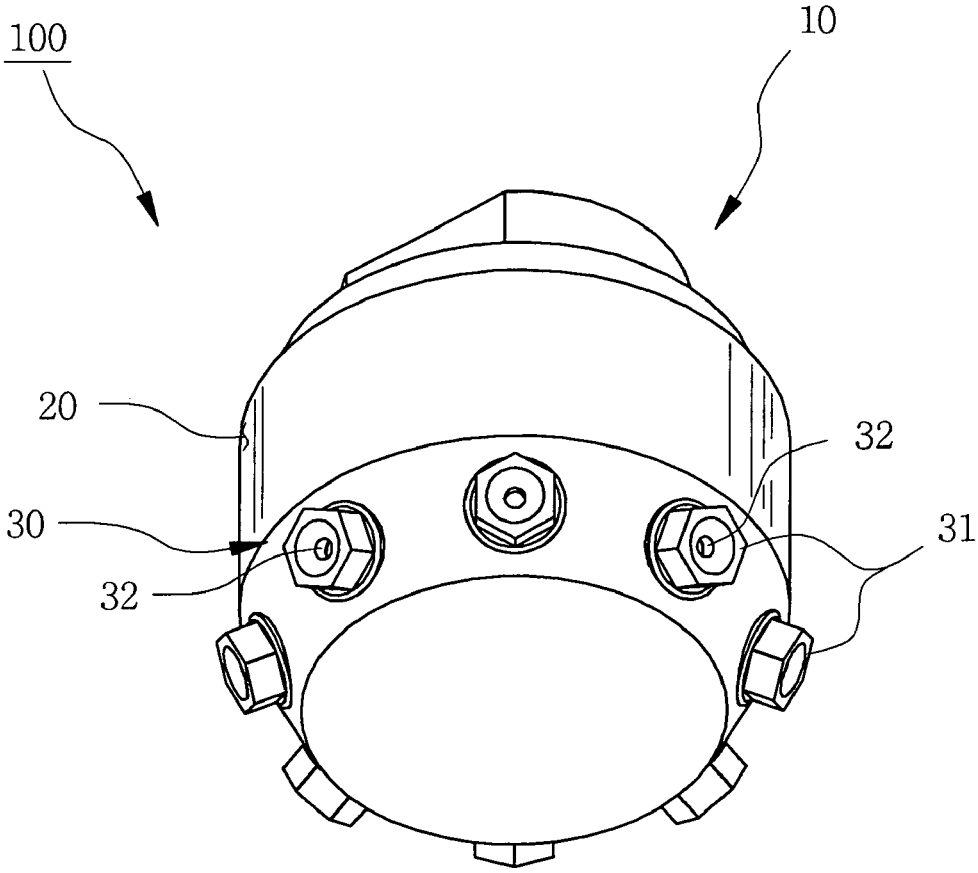

【Fig.3】
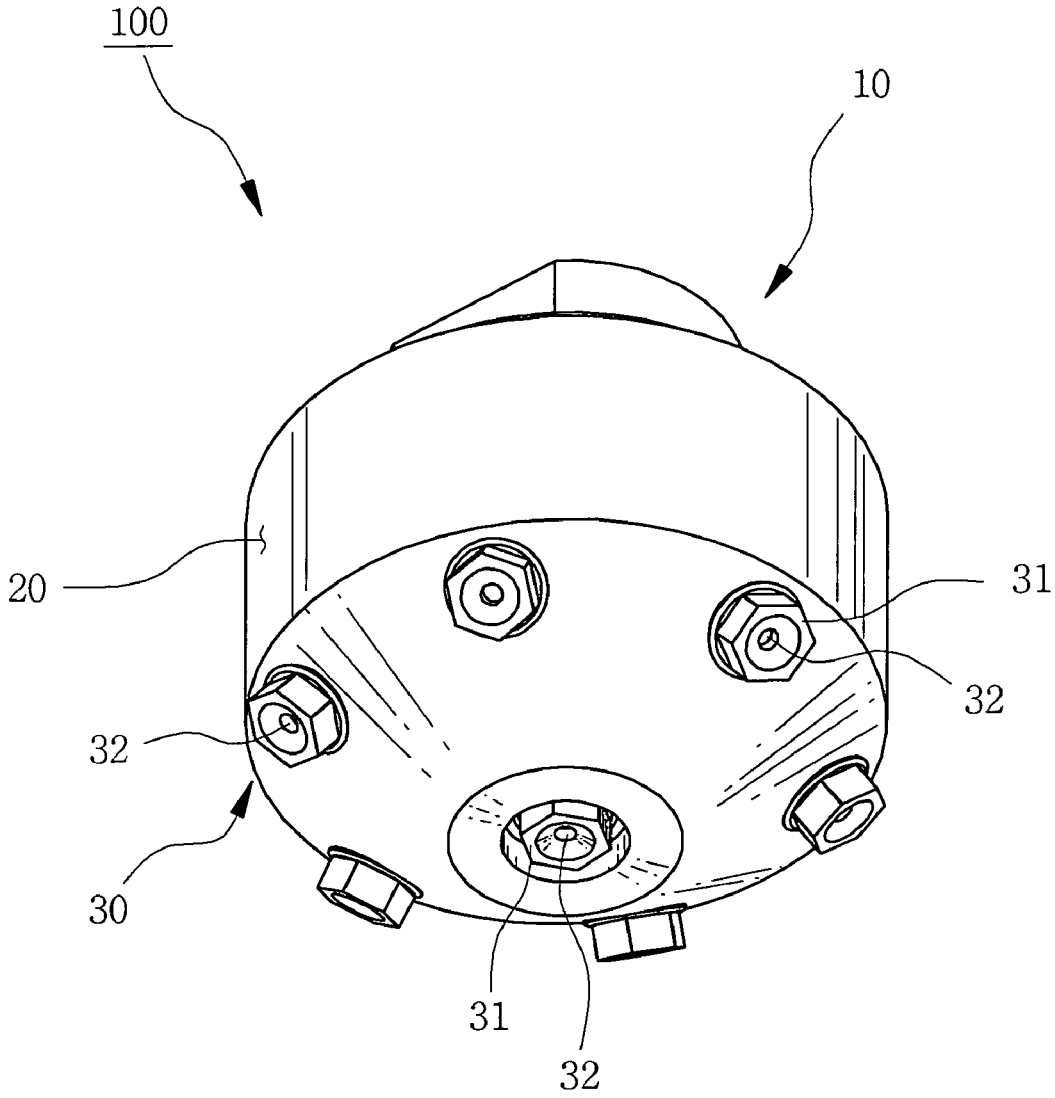

【Fig.4】
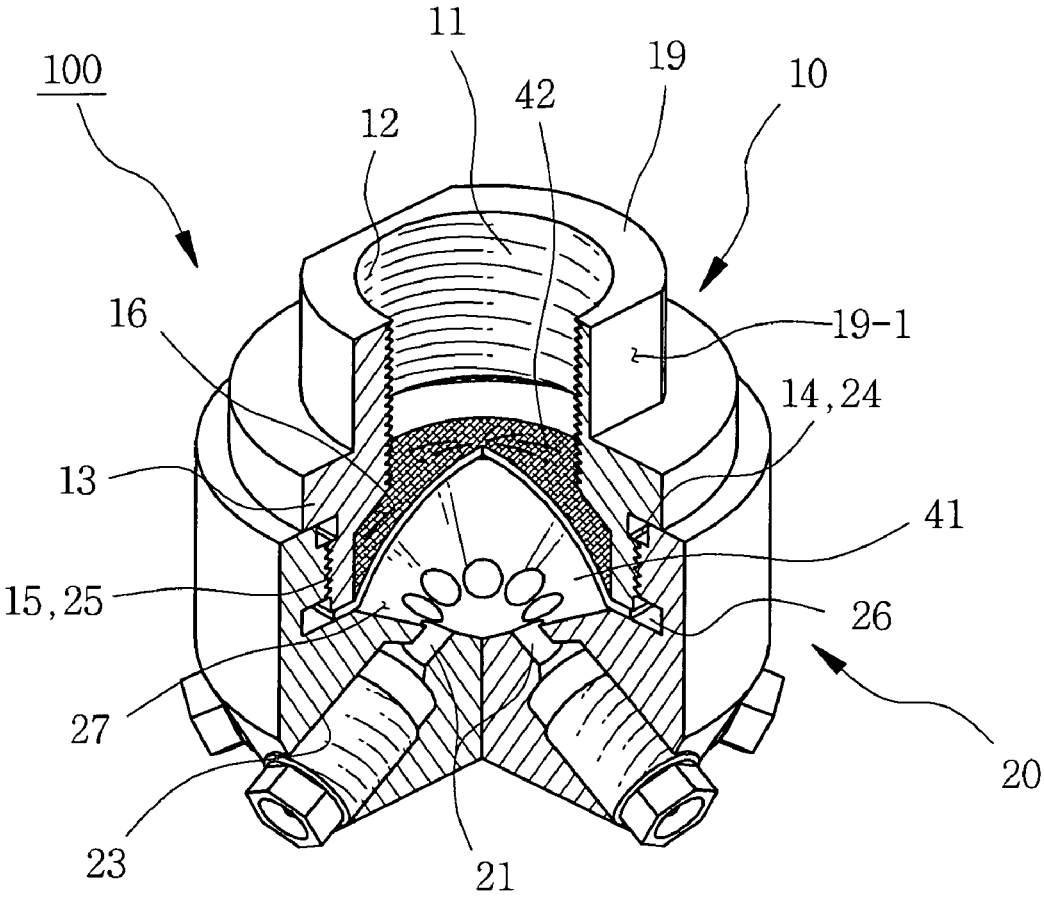

【Fig.5】
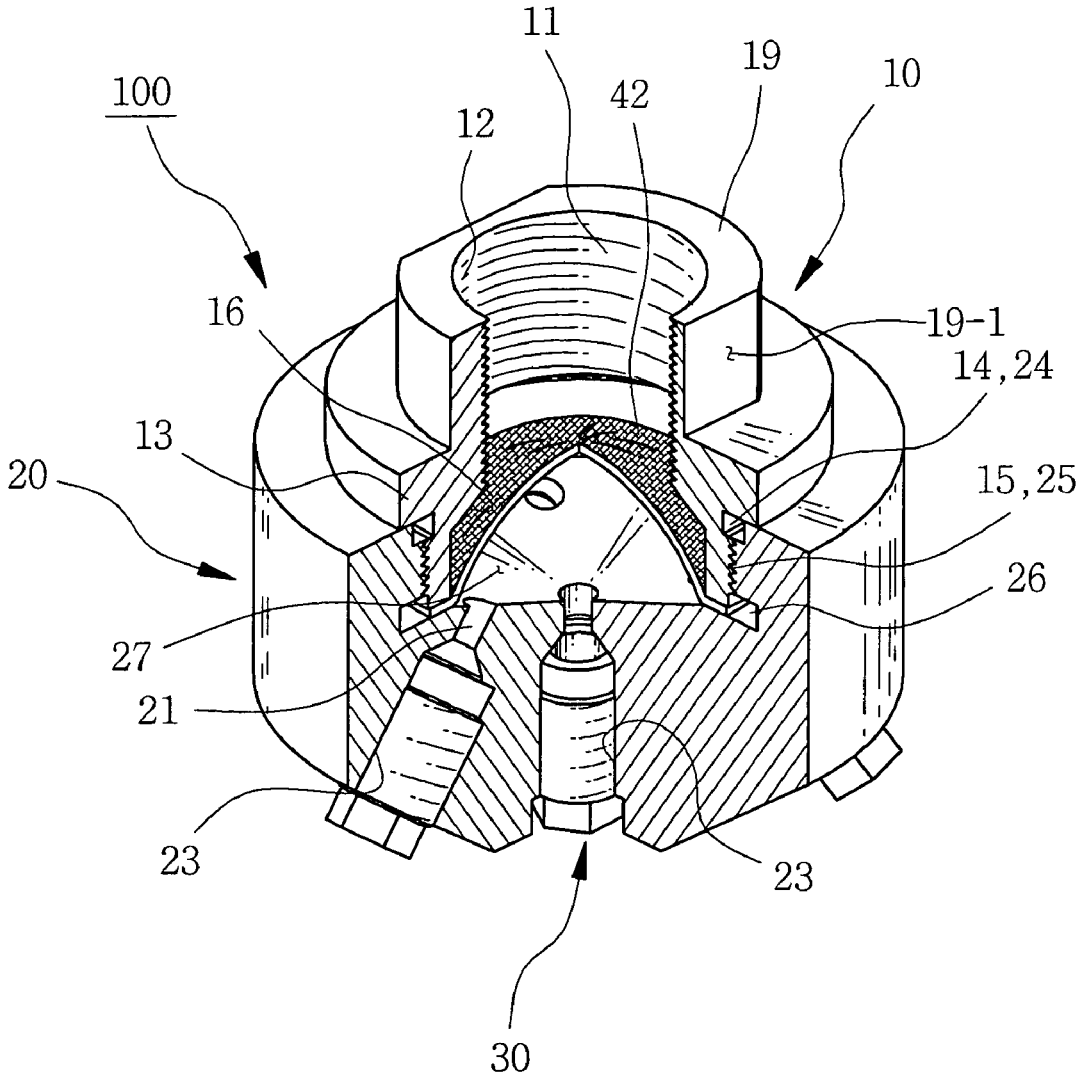

【Fig.6】
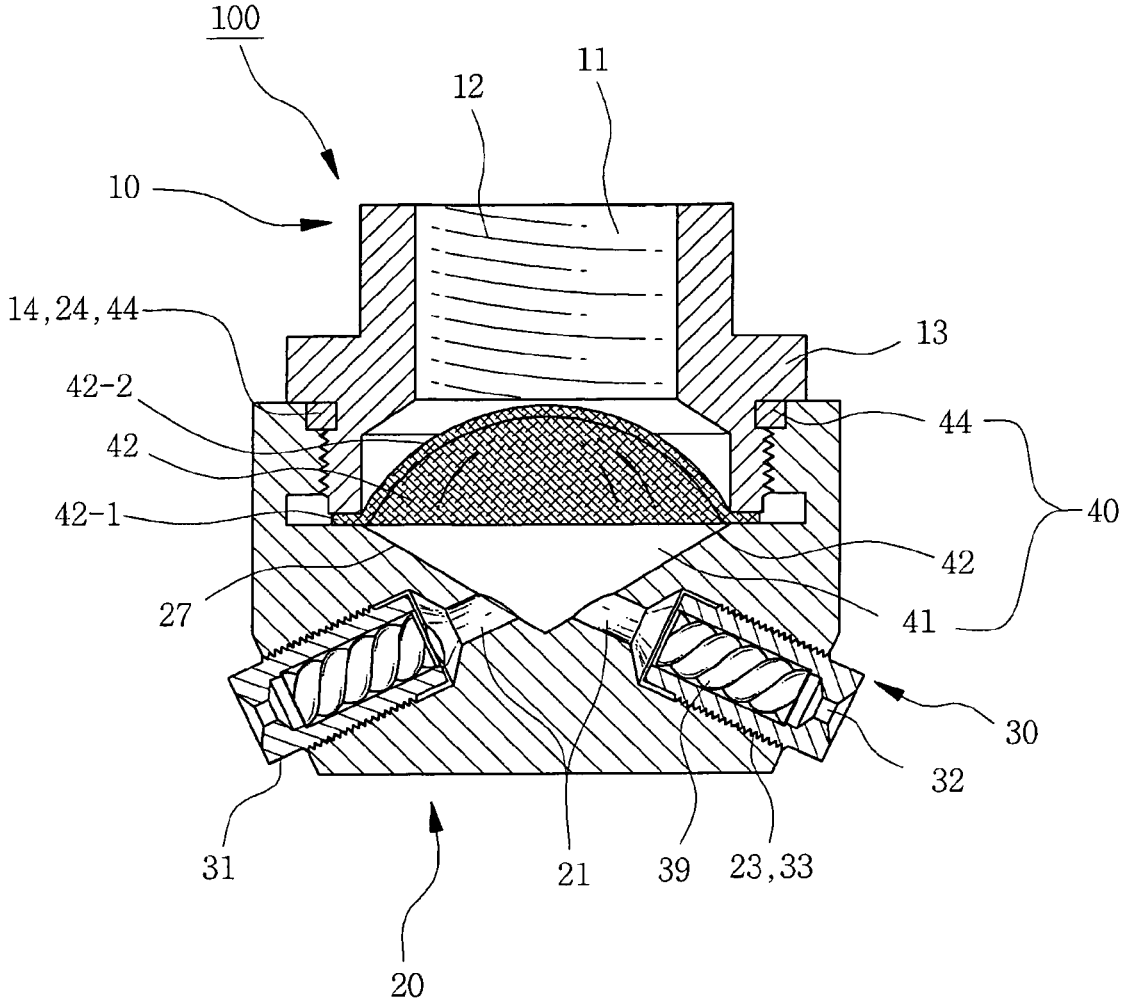

【Fig.7】
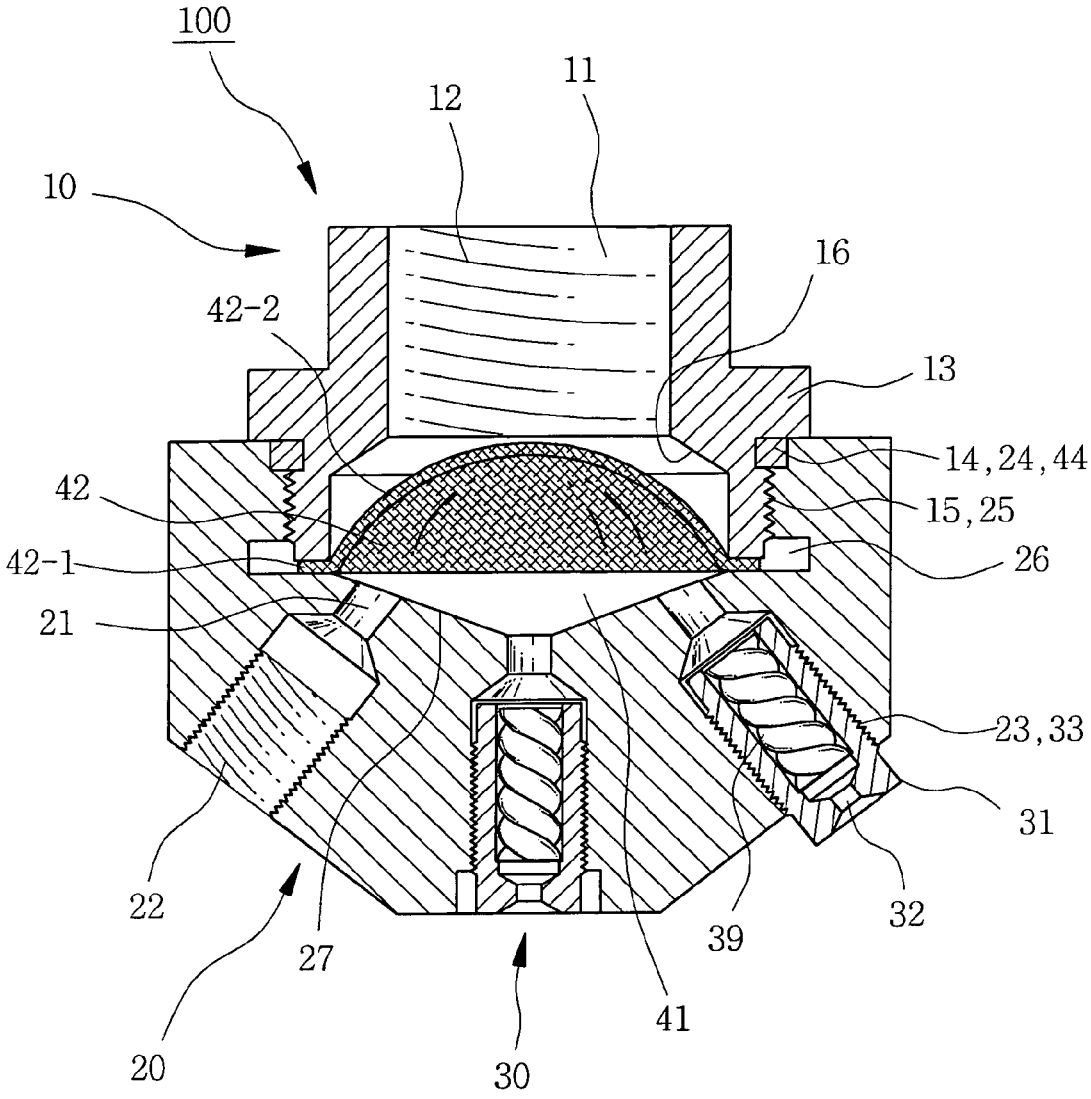

【Fig.8】
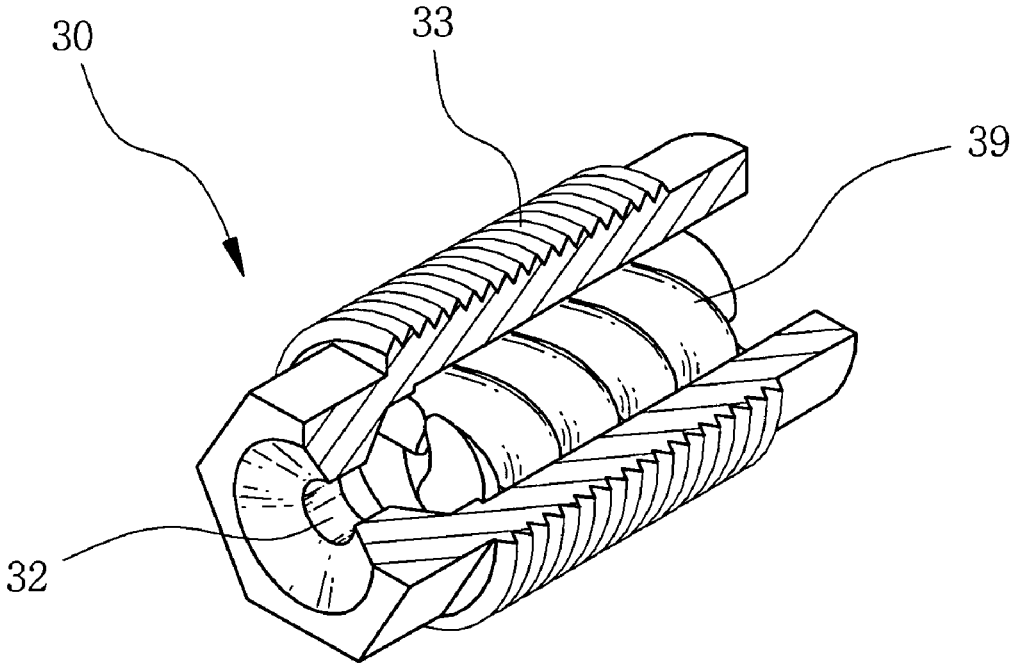

【Fig.9】
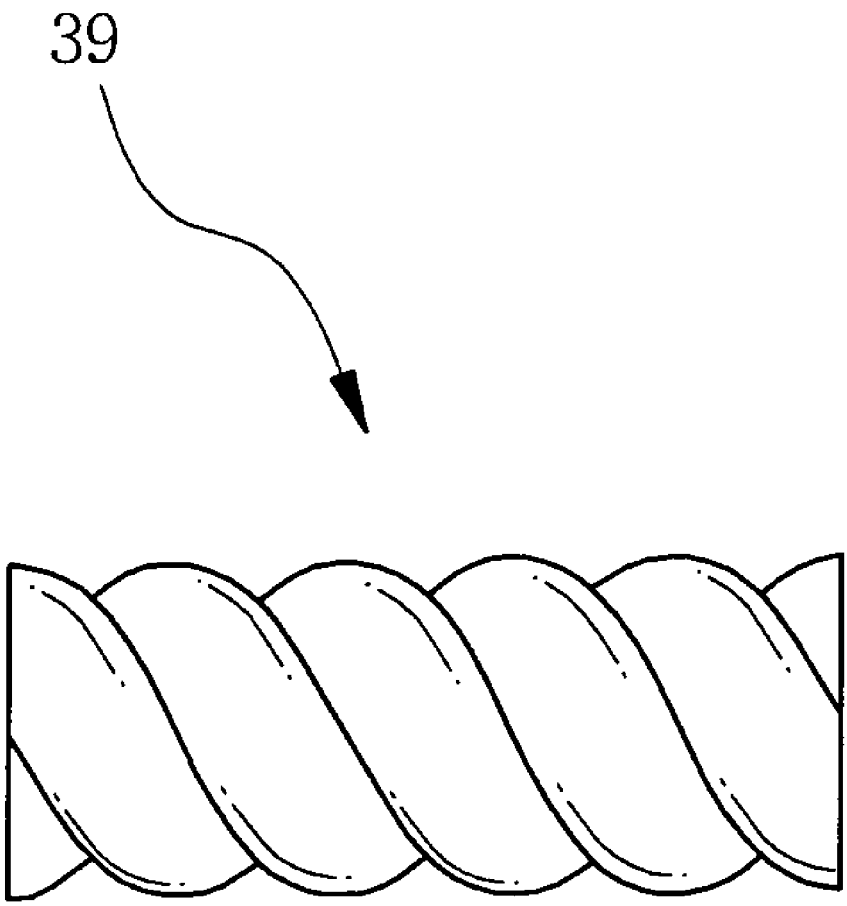

SPRAY DEVICE FOR FIRE FIGHTING

TECHNICAL FIELD

The present invention relates, in general, to spray devices for fire fighting and, more particularly, to a spray device for fire fighting which is not a two fluid-nozzle type using two kinds of fluids, such as gas and water, but is a low-pressure nozzle to spray a single fluid (water) under a pressure of about 10 bar, thus efficiently extinguishing oil fires as well as general fires, and in which nozzle tips atomize water at ends thereof supplied from a fire hydrant or a water source, after swirling the water in the nozzle tips, so that the spray device sprays the atomized water onto a fire, and which has a structure capable of filtering the supplied water in the spray device, thus spraying water without clogging.

BACKGROUND ART

Generally, when fires are caused dry powder fire extinguishers or foam extinguishers put the fires out by spraying chemicals contained in them onto the fires. Alternatively, after hoses are coupled to fire hydrants, high-pressure water, supplied from the fire hydrants, is discharged directly to the fires to extinguish the fires. Typically, halogen was used as fire fighting medium. However, use of halogen has been prohibited due to environmental problems. Therefore, gas and water systems have been used in fire extinguishing devices.

Recently, according to development of fire extinguishing technique, automatic fire extinguishing systems, such as sprinklers arranged on ceilings in buildings to rapidly sense fires and discharge water, have been used to extinguish fires in early stages.

However, the conventional sprinklers, discharge water in large droplets to extinguish fires. Accordingly, compared with the amount of water consumption, the speed of extinguishing the fire is very slow. In addition, in the case of petroleum or gasoline fires, sprinklers cannot efficiently extinguish the oil fires due to the tendency of water not to nix with oil. Furthermore, because a great amount of water is discharged the water may damage materials and articles that would not be harmed by the fires.

In the meantime, conventional fire extinguishing devices using gas ($CO_2$, $N_2$) must be operated after people take shelter and all building vents are closed. Therefore, initial extinguishing operations are nearly impossible. Furthermore, fire extinguishing devices using gas may cause safety hazards due to incorrect operation.

To avoid the above-mentioned problems, another fire extinguishing devices using atomized water have been proposed. In detail, these fire extinguishing devices spray atomized water on fires, thus extinguishing the fires using a relatively small amount of water, preventing subsidiary damage by the water, and reducing construction and manufacturing costs of the fire extinguishing devices. Furthermore, in the fire extinguishing devices using atomized water, sprayed water is changed into vapors by heat of the fires. Due to the generation of the vapor and an increase in volume of vapor due to the heat, density of oxygen around the fires is rapidly reduced. In addition, the generation of vapor prevents radiant heat of the fires from being transferred to surrounding materials, particularly inflammable materials. Therefore, the fire extinguishing devices using atomized water can stably extinguish fires in the early stages.

As such, recently, studies on fire extinguishing devices using atomized water are gathering strength. For example, a fire extinguishing device using atomized water was proposed in Korean Patent Registration No. 210033 (Filed: 22 Apr. 1999), entitled 'FIRE FIGHTING EQUIPMENT', and filed by Sundholm of Finland. Furthermore, a single fluid nozzle using a single fluid was proposed in Korean Utility Model No. 258499 (Filed: 11 Dec. 2001), entitled 'SPRAY NOZZLE FOR FIRE FIGHTING', and filed by Hyundai Fire Industrial Const of Korea. As shown in FIG. 1, another single fluid nozzle using a single fluid was proposed in Korean Utility Model No. 280754 (Filed: 25 Jun. 2002), entitled 'SPRAY DEVICE FOR FIRE FIGHTING', and filed by the inventor of the present invention. In addition, two-fluid nozzles using two kinds of fluids, such as gas and water, were proposed in U.S. Pat. No. 5,014,790, U.S. Pat. No. 4,989,675 and U.S. Pat. No. 2,361,144.

However, the conventional two fluid-nozzles are generally used to extinguish fires in small spaces. Furthermore, because pipes for both gas and water must be arranged the two fluid-nozzles are problematic in that construction costs are increased and difficulty in maintenance remains.

In the meantime, the device of above-mentioned No. 210033 has an integrated single body. Therefore, when the device breaks down, the device causes inconvenience to a user due to the difficulty of disassembling the equipment. Furthermore, the fire fighting equipment uses water under a high pressure of about 50~200 bar. Therefore, leakage of the water may occur in pipes, and thereby the user may be exposed to hazards.

In the meantime, the conventional single fluid nozzles of Korean U.M Registration No. 258499 and No. 208754 do not have a mesh or a filter. Therefore, there exists possibility to deteriorate the ability of the nozzle due to the clogging.

DISCLOSURE OF INVENTION

Technical Problem

Accordingly, the present invention has been made keeping in mind the above-mentioned problems occurring in the prior art, and an object of the present invention is to provide a spray device for fire fighting which is a sort of low-pressure nozzle that generates atomized water using a single fluid such as water, to extinguish a fire, and which is easily and removably coupled to a water supply line, and has a mesh installed in a chamber of the spray device to filter a water, thus preventing the nozzle tips from undesirably clogging due to impurities, and in addition, has a swirl that is provided in each of the nozzle tips to atomize the water into suitable droplets for fire fighting, thus spraying the atomized water onto a fire.

Technical Solution

In order to accomplish the above object, the present invention provides a spray device for fire fighting, including: an upper body, having a through hole provided in a center of an upper part of the upper body, with a first internal thread provided on an inner surface of the through hole, a stopper protruding to an outside from an intermediate portion of an outer surface of the upper body, and a first outer thread provided around a lower portion of the outer surface of the upper body, with a first annular groove provided around the lower portion of the outer surface of the upper body over the first outer thread of the upper body; a lower body which is removably coupled to the upper body and has a second annular groove and a second internal thread provided on an inner surface of the lower body at positions corresponding to the first annular groove and the first outer thread of the upper body, respectively, a plurality of spray channels extending downwards from a first inclined surface provided in a center of the lower body, and a nozzle tip hole communicating with each of the plurality of spray channels, with a third internal thread provided on an inner surface of the nozzle tip hole; a nozzle tip which is removably inserted into the nozzle tip hole and has a bolt head to allow the nozzle tip to be removably inserted into the nozzle tip hole, with an orifice defined in a center of the bolt head a second outer thread provided on an outer surface of the nozzle tip to engage with the third internal thread of the nozzle tip hole, and a swirl inserted into the nozzle tip and provided by twisting two wires; and an interposition unit comprising an O-ring seated in the first and second annular grooves of the upper and lower bodies. The spray device further includes: a second inclined surface with an enlarged diameter extending from a lower end of the through hole of the upper body to a lower part of the upper body; a tightening contact surface for spanner provided on an outer surface of a circular head part which comprises the upper part of the upper body; a working groove provided on the inner surface of the lower body under the second internal thread of the lower body to allow the second internal thread to be formed on the inner surface of the lower body; and a hemispherical mesh having a convex shape, constituting the interposition unit and placed in a chamber, the chamber being defined at a center position between the upper body and the lower body.

DESCRIPTION OF DRAWINGS

The above and other objects, features and other advantages of the present invention will be more clearly understood from the following detailed description taken in conjunction with the accompanying drawings, in which:

FIG. 2 is a perspective view of a spray device for fire fighting according to a first embodiment of the present invention;

FIG. 3 is a perspective view of a spray device for fire fighting according to a second embodiment of the present invention;

FIG. 4 is a partially broken perspective view showing the construction of the spray device of FIG. 2;

FIG. 5 is a partially broken perspective view showing the construction of the spray device of FIG. 3;

FIG. 6 is a sectional view showing the construction of the spray device of FIG. 2;

FIG. 7 is a sectional view showing the construction of the spray device of FIG. 3;

FIG. 8 is a partially broken perspective view of a nozzle tip of the spray device of the present invention; and FIG. 9 is a view showing a swirl which is provided in the nozzle tip of FIG. 8.

BEST MODE

Figure 1:
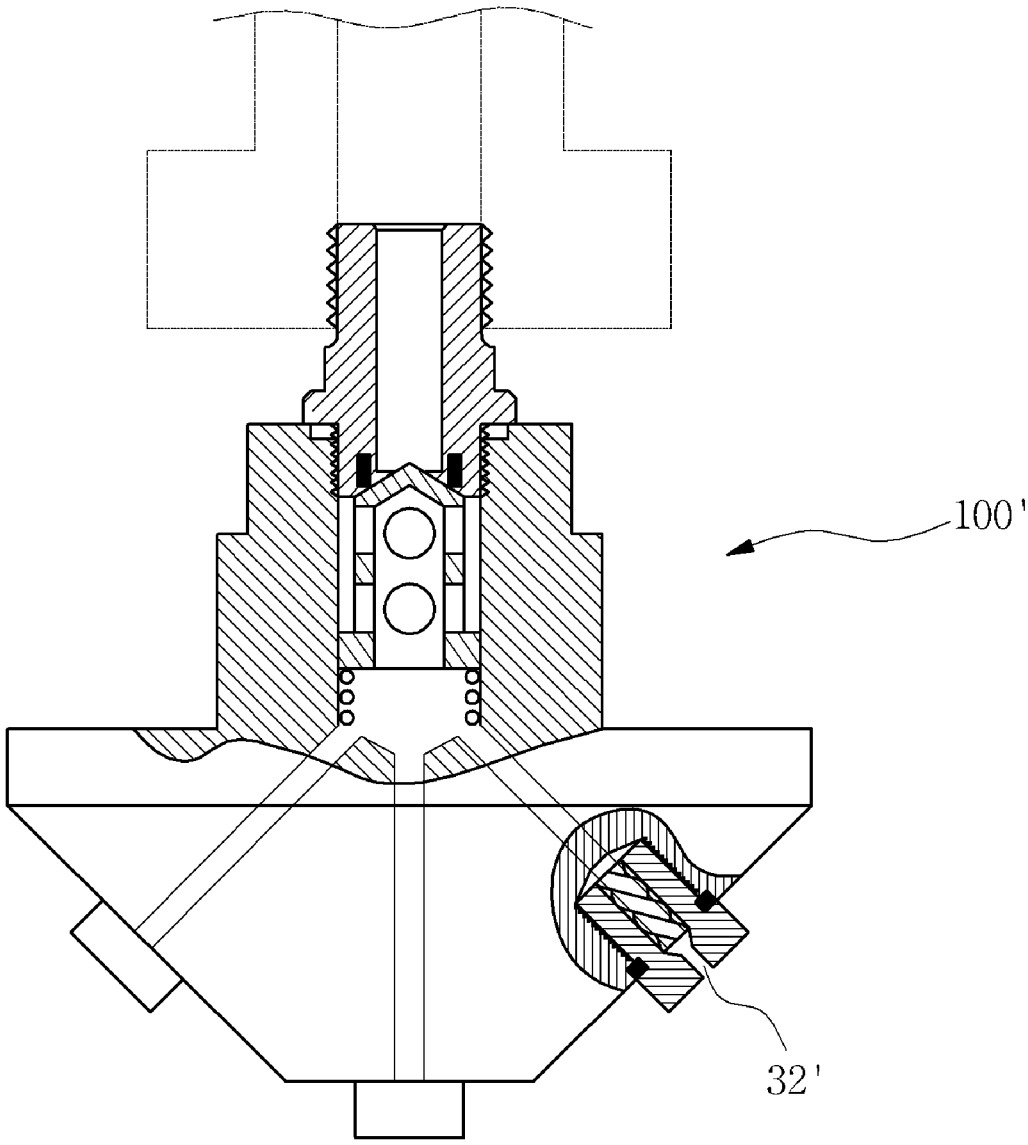
Fig. 1 Prior Art
FIG. 1 is a partial sectional view showing a previous spray device for fire fighting.

Reference should now be made to the drawings, in which the same reference numerals are used throughout the different drawings to designate the same or similar components.

FIG. 2 is a perspective view of a spray device 100 for fire fighting, according to a first embodiment of the present invention. FIG. 3 is a perspective view of a spray device 100 for fire fighting, according to a second embodiment of the present invention. FIG. 4 is a partially broken perspective view showing the construction of the spray device 100 of FIG. 2. FIG. 5 is a partially broken perspective view showing the construction of the spray device 100 of FIG. 3. FIG. 6 is a sectional view showing the construction of the spray device 100 of FIG. 2. FIG. 7 is a sectional view showing the construction of the spray device 100 of FIG. 3. FIG. 8 is a partially broken perspective view of a nozzle tip 30 of the spray device 100 of the present invention. FIG. 9 is a view showing a swirl 39 which is provided in the nozzle tip 30 of FIG. 8.

Referring to the attached drawings, the spray device 100 of the present invention includes an upper body 10 functioning as a coupling part or a nozzle adaptor, and a lower body 20 serving as a nozzle body having a plurality of nozzle tips 30. The spray device 100 further includes an interposition unit 40 which is interposed between the upper and lower body 10 and 20.

As shown in FIGS. 2 and 3 showing the appearances of the spray devices 100 according to the first and second embodiments, in each of the spray devices 100 of FIGS. 2 and 3, the lower body 20 having a frusto-conical shape is coupled to a lower end of the upper body 10. The plurality of nozzle tips 30 are circumferentially arranged on a lower surface of the lower body 20 while protruding from the lower surface of the lower body 20. The plurality of nozzle tips 30 each have a bolt head 31, with an orifice 32 defined in a center of the bolt head 31. The difference in the construction of the spray devices 100 of FIGS. 2 and 3 is as follows. The spray device 100 of FIG. 3 according to the second embodiment has an additional nozzle tip 30 which is inserted into a central portion of a lower part of the lower body 20 to spray water downwards. In the meantime, in the spray device 100 of FIG. 2 according to the first embodiment, a greater number of nozzle tips 30 is circumferentially arranged in the lower body 20, compared to the nozzle tips 30 of the second embodiment.

As shown in FIGS. 4 and 5, in each of the spray devices 100 according to the first and second embodiments, the upper body 10 includes a circular head part 19 at an upper part thereof. A tightening contact surface 19-1 is provided on an outer surface of the circular head part 19. The upper body 10 further includes a through hole 11 which is provided in the center of the circular head part 19. The upper body 10 further includes a first thread 12 which is provided on an inner surface of the through hole 11 of the circular head part 19 to allow the spray device 100 to be coupled to a water supply line. An inclined surface 16 is formed under the first internal thread 12. The first thread 12 is formed into an internal thread type to prevent the first thread 12 from being damaged. The first internal thread 12 allows the spray device 100 to be easily and removably coupled to the water supply line according to circumstances. The upper body 10 further includes a stopper 13 which protrudes to the outside from an intermediate portion of an outer surface of the upper body 10 under the circular head part 19. The upper body 10 further includes a first annular groove 14 which is provided around the outer surface of the upper body 10 under the stopper 13. A first outer thread 15 is provided around the outer surface of the upper body 10 under the first annular groove 14.

The lower body 20 includes a second annular groove 24 and a second internal thread 25 which are provided on an inner surface of the lower body 20 at positions corresponding to the first annular groove 14 and the first outer thread 15 of the upper body 10, respectively. The lower body 20 further includes a working groove 26 which is provided on the inner surface of the lower body 20 under the second internal thread 25 of the lower body 20 to allow the second internal thread 25 to be formed on the inner surface of the lower body 20. The lower body 20 further includes a plurality of spray channels 21 which extend in circumferential directions from an inclined surface 27 which is provided in a center of the lower body 20. Alternatively, the plurality of spray channels 21 may extend in circumferential and vertical directions from an inclined surface 27, as shown in FIG. 5. The plurality of spray channels 21 allows the spray device 100 to select a direction of discharging water according to the usage of the spray device 100. That is, the numbers of the spray channels 21 and the nozzle tips 30 may be changed to change directions of discharging water according to the usage of the spray device 100. Furthermore, the orifice 32 may also be changed according to the usage of the spray device 100. The lower body 20 further includes a plurality of nozzle tip holes 22 which communicate with the plurality of spray channels 21, with a third internal thread 23 provided on an inner surface of the nozzle tip hole 22. The nozzle tip 30 is removably inserted into each of the nozzle tip holes 22 (see, FIG. 7).

Referring to FIGS. 6 and 7, the spray device 100 of the present invention further includes a hemispherical mesh 42 which has a convex shape and constitutes the interposition unit 40 to be provided between the upper and lower bodies 10 and 20. The hemispherical mesh 42 is placed in a chamber 41 defined at a center position of the spray device 100. The hemispherical mesh 42 has an annular flange 42-1 and a hemispherical surface part 42-2. The spray device 100 further includes an O-ring 44 which is seated in the first and second annular grooves 14 and 24 of the upper and lower bodies 10 and 20 to prevent water leakage. The annular flange 42-1 is provided around a circumferential edge of the hemispherical mesh 42 to be compression-held between a lower end of the upper body 10 and an upper end of the first inclined surface 27 of the lower body 20. The hemispherical surface part 42-2 has a curved surface to increase the filter surface area. The top of the hemispherical surface part 42-2 is placed at the same height as that of an upper portion of the inclined surface 16 of the upper body 10. Due to the hemispherical mesh 42, impurities having diameters larger than that of the orifices 32 of the nozzle tips 30 are removed from the water to be supplied to the nozzle tips 30.

As shown in FIGS. 6 through 9, the nozzle tip 30 is removably inserted into each of the nozzle tip holes 22, which communicates with the spray channels 21, through the threaded engagement structure. The nozzle tip 30 atomizes water which is supplied from the water supply line. The nozzle tip 30 includes the bolt head 31 which has the orifice 32 in the center thereof and a second outer thread 33 which is provided on an outer surface of the nozzle tip 30 to engage with the third internal thread 23 of the nozzle tip hole 22. The nozzle tip 30 further includes the swirl 39 which is inserted into the nozzle tip 30 and provided by twisting two linear wires. The nozzle tips 30 are circumferentially arranged at regular intervals to spray the atomized water over a wide angle. The inner diameter of the nozzle tip 30 gradually narrows from the swirl 39 to the orifice 32, and gradually enlarges from the orifice 32 to an end of the nozzle tip 30. The nozzle tip 30 may be provided on the center of the lower surface of the lower body 20 to spray atomized water downwards, as shown in FIG. 7.

The operation of the spray device 100 of the present invention will be described herein below.

The spray device 100 is coupled to the water supply line through the first inner thread 12 of the upper body 10. Thereafter, water is supplied to the spray device 100 from an outside water source through the water supply line. Then, the supplied water is filtered by the hemispherical mesh 42, which is placed in the watertight chamber 41, while being diffused by passing through the through hole 11 having the inclined surface 16. Thus, impurities are removed from the water passing through the hemispherical mesh 42. Thereafter, the water passing through the hemispherical mesh 42 is supplied to the plurality of nozzle tips 30 via the plurality of spray channels 21. The water, supplied to each of the nozzle tips 30, obtains sufficient rotation while passing through the swirl 39 which is provided in back of the orifice 32 in the nozzle tip 30. Thereafter, the water, having sufficient rotation, is discharged to the outside after passing through the orifice 32 having a narrow inner diameter. At this time, the water, which passed through the orifice 32, is rapidly decompressed while being diffused at the end of the nozzle tip 30 which is enlarged in the inner diameter in a trumpet shape. Therefore, the water passing through the nozzle tips 30 is atomized and simultaneously, sprayed to the outside at a wide angle.

INDUSTRIAL APPLICABILITY

As described above, the present invention provides a spray device for fire fighting, which efficiently extinguishes general fires and oil fires in addition to electrical fires using only environmentally-friendly water, and in which the number and direction of the nozzle tips can be changed according to the usage. Furthermore, the spray device of the present invention uses water at low pressure, thus simplifying design, manufacturing and construction processes thereof and being convenient to maintain. In addition, the spray device sprays water after atomizing the water, thus efficiently intercepting heat radiated from a fire, reducing dust generated at the scene of the fire, and minimizing consumption of water. Moreover, the spray device of the present invention is easily coupled to and removed from a water supply line. Furthermore, the spray device has a hemispherical mesh to filter water supplied from the water supply line, thus preventing nozzle tips from clogging due to impurities.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A spray device for fire fighting, comprising:

an upper body, comprising:

a through hole provided in a center of an upper part of the upper body, with a first internal thread provided on an inner surface of the through hole;

a stopper protruding to an outside from an intermediate portion of an outer surface of the upper body; and a first outer thread provided around a lower portion of the outer surface of the upper body, with a first annular groove provided around the lower portion of the outer surface of the upper body over the first outer thread of the upper body;

a lower body removably coupled to the upper body, and comprising:

a second annular groove and a second internal thread provided on an inner surface of the lower body at positions corresponding to the first annular groove and the first outer thread of the upper body, respectively;

a plurality of spray channels extending downwards from a first inclined surface provided in a center of the lower body; and a plurality of nozzle tip holes each communicating with each of the plurality of spray channels, with a third internal thread provided on an inner surface of each of the nozzle tip holes;

a plurality of nozzle tips removably inserted into the nozzle tip holes, and comprising:

a bolt head to allow the nozzle tip to be removably inserted into the nozzle tip hole, with an orifice defined in a center of the bolt head;

a second outer thread provided on an outer surface of the nozzle tip to engage with the third internal thread of the nozzle tip hole; and a swirl inserted into the nozzle tip and provided by twisting two wires; and an interposition unit comprising an O-ring seated in the first and second annular grooves of the upper and lower bodies, wherein the spray device further comprises a hemispherical mesh having a convex shape, constituting the interposition unit and placed in a chamber, the chamber being defined at a center position between the upper body and the lower body;

the upper body further comprises a second inclined surface with an enlarged diameter extending from a lower end of the through hole of the upper body to a lower part of the upper body and a tightening contact surface provided on an outer surface of a circular head part which comprises the upper part of the upper body; and the lower body further comprises a working groove provided on the inner surface of the lower body under the second internal thread of the lower body to allow the second internal thread to be formed on the inner surface of the lower body.

2. The spray device according to claim 1, further comprising:

an annular flange provided around a circumferential edge of the hemispherical mesh to be compression-held between a lower end of the upper body and an upper end of the first inclined surface of the lower body.

3. The spray device according to claim 1, wherein the hemispherical mesh is provided such that a top of a hemispherical surface part thereof is placed at a same height as a height of an upper portion of the second inclined surface of the upper body.

* * * * *